US007762479B2

(12) United States Patent
Li

(10) Patent No.: US 7,762,479 B2
(45) Date of Patent: Jul. 27, 2010

(54) ADJUSTABLE SHOWERHEAD WITH CERAMIC DISK ASSEMBLY

(75) Inventor: Zhiyong Li, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 365 days.

(21) Appl. No.: 12/079,590

(22) Filed: Mar. 27, 2008

(65) Prior Publication Data

US 2009/0242666 A1 Oct. 1, 2009

(51) Int. Cl.
*A62C 31/02* (2006.01)
*A62C 31/00* (2006.01)
*B05B 1/30* (2006.01)

(52) U.S. Cl. ..... 239/396; 239/391; 239/443; 239/579; 239/581.1; 239/DIG. 19

(58) Field of Classification Search ..... 239/390, 239/391, 392, 394, 396, 436, 437, 438, 443, 239/444, 445, 446, 456, 457, 458, 460, 553, 239/575, 579, 581.1, 581.2, 582.1, DIG. 19
See application file for complete search history.

(56) References Cited

U.S. PATENT DOCUMENTS 4,145,004 A 3/1979 Krizik
4,754,928 A * 7/1988 Rogers et al. ..... 239/381
5,090,624 A * 2/1992 Rogers ..... 239/381
5,093,943 A 3/1992 Wei
5,558,278 A 9/1996 Gallorini
5,901,387 A * 5/1999 Fan ..... 4/675
6,412,710 B1 * 7/2002 Lin et al. ..... 239/436
6,557,770 B2 5/2003 Mace et al.
6,854,658 B1 2/2005 Houghton et al.
6,959,731 B2 11/2005 Bartkus et al.
7,080,790 B2 7/2006 Lorch
7,114,515 B2 10/2006 Sponheimer et al.
7,303,151 B2 * 12/2007 Wu ..... 239/447
2006/0016001 A1 1/2006 Zhao
2006/0060678 A1 3/2006 Mazzola

FOREIGN PATENT DOCUMENTS

EP 1 293 712 A2 3/2003

* cited by examiner

*Primary Examiner*—Dinh Q Nguyen
*Assistant Examiner*—Ryan Reis
(74) *Attorney, Agent, or Firm*—McDermott Will & Emery LLP

(57) ABSTRACT

The invention provides an adjustable showerhead that provides a variety of distinct discharge water patterns. The showerhead features a ceramic disk assembly that provide long-life and reliable operation to the showerhead. The showerhead includes a wand having a receiver with a discharge outlet and a depending lug. The disk assembly includes an upper ceramic disk fixedly positioned within the receiver, and has a curvilinear groove and a water inlet hole that receives water from the wand's discharge outlet. A lower ceramic disk is movably positioned within the receiver against the upper disk, and has a plurality of outlet holes arrayed along the periphery. A bushing resides within a central opening of the lower disk and operably connects the lower disk to the receiver. An outlet assembly is operably connected to the lower disk, and includes an inner faceplate with a plurality of discharge outlets, and an outer faceplate with a plurality of discharge outlets. An adjusting ring is operably connected to the lower disk. An operator rotates the adjusting ring to move the showerhead between various disk positions to attain the desired water discharge pattern.

25 Claims, 7 Drawing Sheets

ADJUSTABLE SHOWERHEAD WITH CERAMIC DISK ASSEMBLY

CROSS-REFERENCE TO RELATED APPLICATION

Not applicable

FEDERALLY SPONSORED RESEARCH OR DEVELOPMENT

Not applicable

TECHNICAL FIELD

The invention relates to an adjustable showerhead with an internal ceramic disk assembly. More specifically, the internal disk assembly of the showerhead includes an upper stationary ceramic disk and a lower moveable ceramic disk that may be actuated by an operator to provide a variety of water discharge patterns.

BACKGROUND OF THE INVENTION

Adjustable showerheads that discharge a number of different water modes, such as pulsating water pattern, a steady-stream pattern, bubble or oxygenated pattern, and an alternating pattern, for commercial and residential use are well-known. These showerheads typically include a stem, an internal disk assembly having a plurality of stacked disks, an outlet assembly with discharge openings, and an actuator that is engaged by an operator to adjust the discharge water pattern as desired. For example, the operator may rotate the actuator to vary the showerhead between a pulsating water pattern and a steady-stream pattern. The actuator is operably connected to a disk of the disk assembly, whereby the disk is rotated between various positions that correspond to the discharge water patterns.

Conventional showerheads suffer from a number of limitations that negatively affect their durability, performance and cost of manufacture. For example, conventional showerheads include a disk assembly with stacked disks that are prone to premature wear. This wear compromises operating performance, namely the quality and quantity of the discharge water patterns, during the life of the showerhead. The present invention is provided to solve these limitations and to provide other advantages and aspects not provided by conventional showerheads. A full discussion of the features and advantages of the present invention is deferred to the following detailed description, which proceeds with reference to the accompanying drawings.

SUMMARY OF THE INVENTION

The present invention is directed to a showerhead that is adjustable to provide a variety of discharge water patterns. The showerhead includes a wand that receives water from a supply conduit, a ceramic disk assembly residing within the showerhead, and an outlet assembly that provides the discharge water pattern selected by the operator According to one aspect of the invention, the wand or housing includes a water inlet and a receiver that includes a discharge outlet and a depending lug that functions as a connection point for the disk assembly and the outlet assembly. The ceramic disk assembly functions as a water diverter for the various discharge water patterns, and includes an upper ceramic disk, a lower ceramic disk, and a bushing. The upper ceramic disk is stationary or fixedly positioned within the receiver. The upper disk has a central opening through which an extent of the wand lug extends. The upper disk also has an inlet hole and a curvilinear groove. The lower ceramic disk is movably positioned adjacent or against the upper disk. The lower disk has a first outlet hole, a second outlet hole, a third outlet hole and a fourth outlet hole, all positioned radially outward of the central opening. The bushing of the disk assembly resides within the central opening of the lower disk to fix the position of the bushing while allowing for rotation of the lower disk.

According to another aspect of the invention, the outlet assembly is operably connected to the lower disk to provide the water discharge pattern selected by the operator. The outlet assembly includes a central bore that receives an elongated fastener, and an inner faceplate with a plurality of discharge outlets that provide a specific water discharge pattern. The outlet assembly also includes an outer faceplate with a plurality of discharge outlets that provide a specific water discharge pattern. A flange extends from the outer faceplate and into the receiver of the wand. A peripheral adjusting ring that an operator actuates to select the discharge water pattern is operably connected to the lower disk via the flange.

According to yet another aspect of the invention, the operator rotates the adjusting ring to move the showerhead between various disk positions to attain the desired water discharge pattern. In a first position, the first outlet and the second outlet of the lower disk are aligned with the groove of the upper disk to provide a first discharge water pattern. In a second position, the second outlet of the lower disk is aligned with the groove to provide a second discharge water pattern. In a third position, the third outlet of the lower disk is aligned with the groove to provide a third discharge water pattern. In a fourth position, the third and fourth outlets of the lower disk are aligned with the groove to provide a fourth discharge water pattern. In a fifth position, the fourth outlet is aligned with the groove to provide a fifth discharge water pattern. Preferably, each discharge water pattern is distinct from the other discharge water patterns.

For a more complete understanding of the present invention, reference should be had to the accompanying drawings as well as the descriptive matter in which there is illustrated and described the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
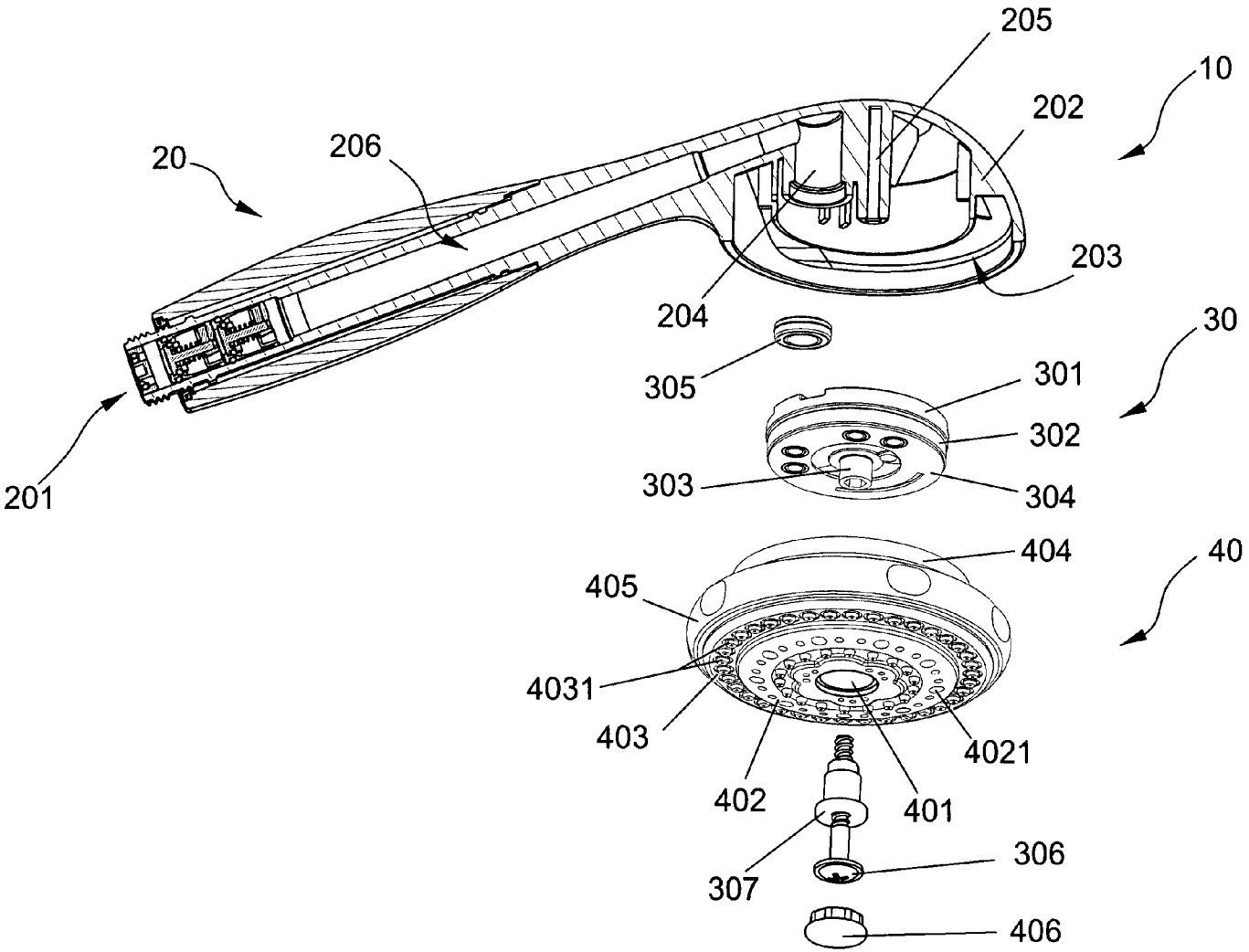
FIG. 1 is a partial exploded view of the inventive showerhead, showing a ceramic valve assembly.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Structure

FIGS. 1-7 show an embodiment of a showerhead 10 of the present invention. The showerhead 10 is adjustable to provide a variety of discharge water patterns, including a pulsating water pattern, a wide spray pattern, a narrow spray pattern, a bubble or oxygenated pattern, an alternating pattern, or a combined pattern. Further, the showerhead 10 may be configured to provide different types of the same pattern, such as a "hard" pulsation effect, a "medium" pulsation effect, or a "soft" pulsation effect which provide different tactile sensations to the operator during use of the showerhead 10.

The showerhead 10 includes a wand 20 that receives water from a supply conduit (not shown), a ceramic disk assembly 30 residing within the showerhead 10, and an outlet assembly 40 that provides the discharge water pattern.

Figure 2:
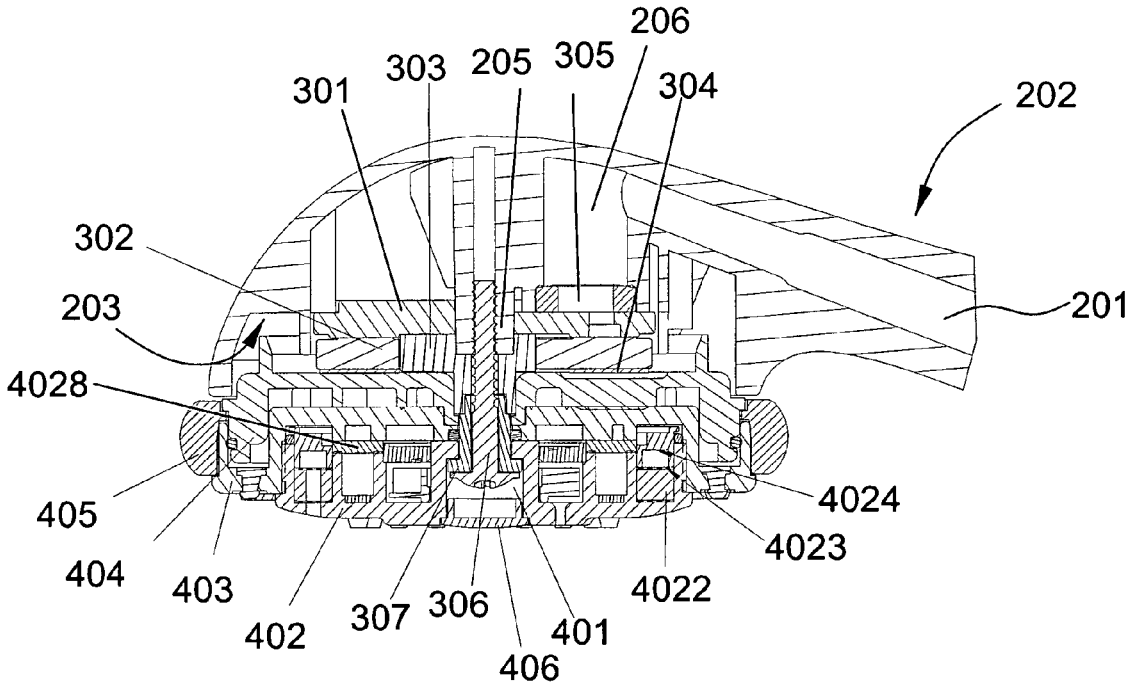
FIG. 2 is a sectional view of the showerhead of FIG. 1.

The wand or housing 20 may be stationary via a wall or ceiling mount, or portable such that an operator can hold and articulate it during use. Referring to FIGS. 1 and 2, the wand 20 includes a water inlet 201 and a body portion 202 defining a receiver 203. The receiver 203 includes a discharge outlet 204 through which water flows, and a central depending lug 205 that functions as a connection point for the disk assembly 30 and the outlet assembly 40. The body 202 also includes a waterway 206 that is in fluid communication with the inlet 201 and that leads to the disk assembly 30. As explained below, the disk assembly 30 and the outlet assembly 40 reside within the receiver 203.

The ceramic disk assembly 30 functions as a water diverter for the various discharge water patterns, and includes a first or upper ceramic disk 301, a second or lower ceramic disk 302, a bushing 303, a sealing element or gasket 304, and a sealing ring 305. Compared to conventional disks that are prone to premature wear due to their materials, the upper and lower ceramic disks 301, 302 provide long-life and reliable operation to both the assembly 30 and the showerhead 10. The upper ceramic disk 301 is stationary or fixedly positioned within the receiver 203 of the wand 20.

Figure 3:
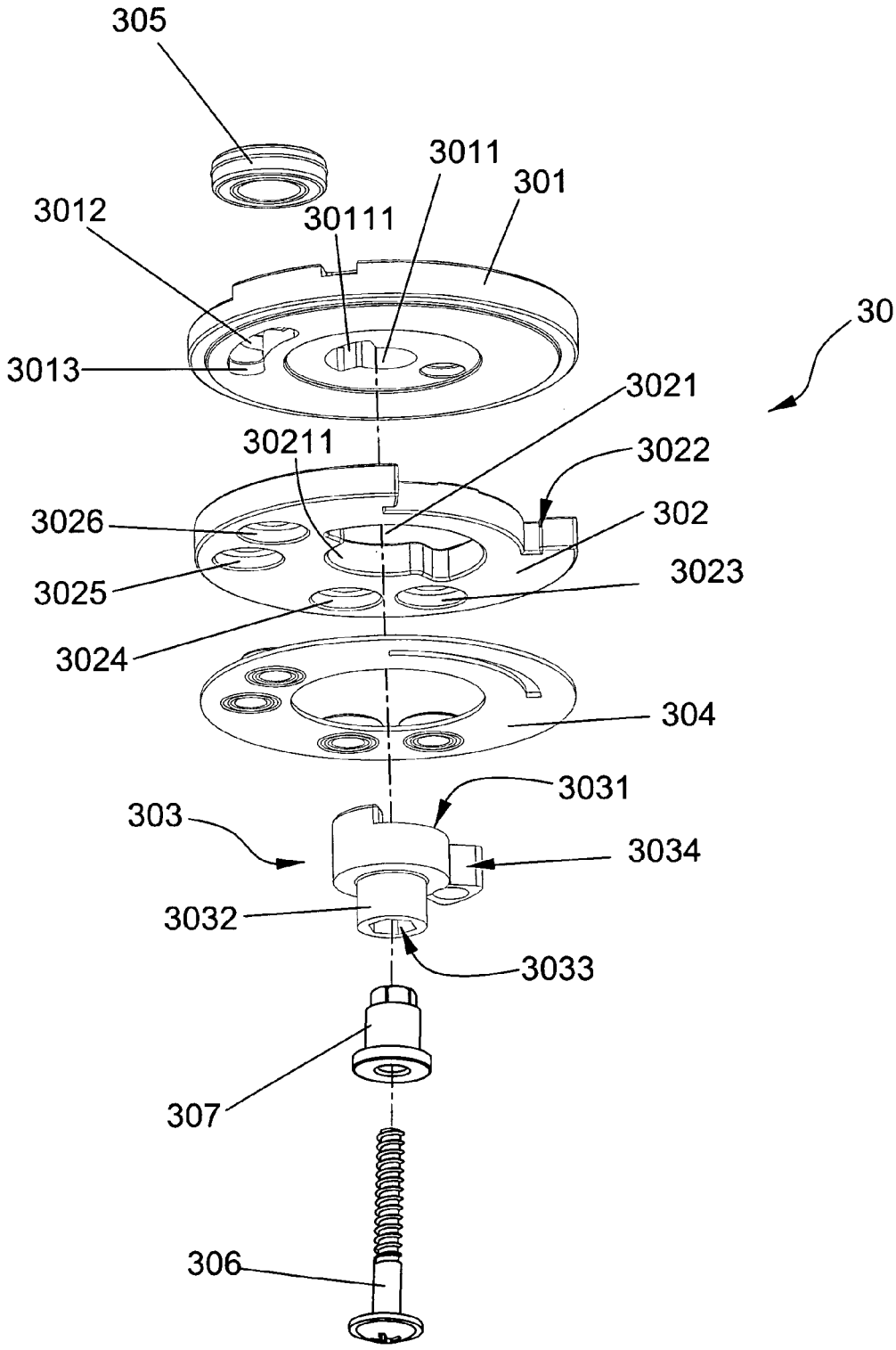
FIG. 3 is an exploded view of a ceramic disk assembly of the showerhead of FIG. 1.

As may be seen in FIG. 3, the upper disk 301 has a central opening 3011 through which an extent of the central depending lug 205 extends in the use position of FIG. 2. The central opening 3011 has an outwardly extending lobe 30111. An upper portion of the upper disk 301 has an inlet hole 3012, and a lower portion of the disk 301 has a curvilinear groove 3013. The inlet hole 3012 and the groove 3013 are substantially aligned or coincident to define a water passageway that receives water from the waterway 206 for distribution to the lower disk 302. Preferably, the area of the groove 3013 exceeds the area of the inlet hole 3012 (see FIGS. 2 and 3).

The lower ceramic disk 302 is movably positioned adjacent or against the upper disk 301. As may best be seen in FIG. 3, the lower disk 302 has a central opening 3021 with an outwardly extending lobe 30211. The lower disk 302 also has a peripheral notch 3022. The lower disk 302 further has a plurality of outlet holes, preferably a first outlet hole 3023, a second outlet hole 3024, a third outlet hole 3025 and a fourth outlet hole 3026, all positioned radially outward of the central opening 3021. Described differently, the first through fourth outlets 3023-3026 are arrayed along the periphery of the lower disk 302. As explained below, the outlets 3023-3026 are alignable with the groove 3013 to provide the selected discharge water pattern.

The bushing 303 of the disk assembly 30 resides within the central opening 3021 of the lower disk 302. Referring to FIGS. 2 and 3, the bushing 303 has an upper recess 3031 that receives a lower extent of the lug 205. This structural interaction between the bushing 303, the lower disk 302 and the lug 205 of the wand 20 fixes the position of the bushing 303 while allowing for rotation of the lower disk 302 about the bushing 303. As a result, the lower disk 302 is movable with respect to the stationary upper disk 301. Referring to FIGS. 2 and 3, the bushing 303 also includes a depending projection 3032 that extends downward into the outlet assembly 40, and an outwardly extending finger 3034 that engages the lower disk 302. The bushing 303 further includes a central opening 3033 that receives an elongated fastener 306, such as a threaded screw, and a sleeve 307 to operably connect the disk assembly 30 and outlet assembly 40 to the wand 20. As mentioned above, the disk assembly 30 includes two sealing elements—a gasket 304 positioned against a lower surface of the lower disk 302, and a sealing ring 305 positioned against an upper surface of the upper disk 301 within the waterway 206.

In general terms, and as best seen in FIG. 1, the outlet assembly 40 is operably connected to the lower disk 302 to provide the water discharge pattern selected by the operator. The outlet assembly 40 includes a central bore 401 and an inner faceplate 402 that resides radially outward of the central bore 401. The inner faceplate 402 includes a plurality of discharge outlets 4021 that provide a specific water discharge pattern. The inner faceplate 402 may be configured to provide aerated or "bubbly" discharge water through the outlets 4021, wherein the faceplate 402 includes "bubble" ring 4022, a filter 4023 and a lid 4024 (see FIG. 2).

As may be seen in FIG. 1, the outlet assembly 40 also includes an outer faceplate 403 with a plurality of discharge outlets 4031 that provide a specific water discharge pattern, with the outer faceplate 403 residing radially outward of the inner faceplate 402. A flange 404 extends from the outer faceplate 403 and into the receiver 203 of the wand 20, wherein the flange 404 engages a rim of the receiver 203. An adjusting ring 405 that an operator actuates to select the discharge water pattern resides radially outward of both the flange 404 and the outer faceplate 403. The adjusting ring 405 is operably connected to the flange 404 and the outer faceplate 403. The inner and outer faceplates 402, 403 and the flange 404 each include a central opening that collectively define the bore 401. The central bore 401 receives the elongated fastener 306 to operably connect the outlet assembly 40 to the lug 205 and the lower disk 302. A trim cap 406 (see FIG. 2) encloses the central bore 401 and the fastener 306.

Operation—Discharge Water Patterns

As mentioned above, the adjustable showerhead 10 is capable of providing a variety of discharge water patterns, including a pulsating water pattern, a steady-stream pattern, bubble or oxygenated pattern, an alternating pattern, or a combined pattern. Along those lines, the following paragraphs explain the operation of the showerhead 10 detailing the various operating positions and the attendant water discharge patterns. The operator rotates the adjusting ring 405 to move the showerhead 10 between the various positions and attain the desired water discharge pattern.

Figure 4:
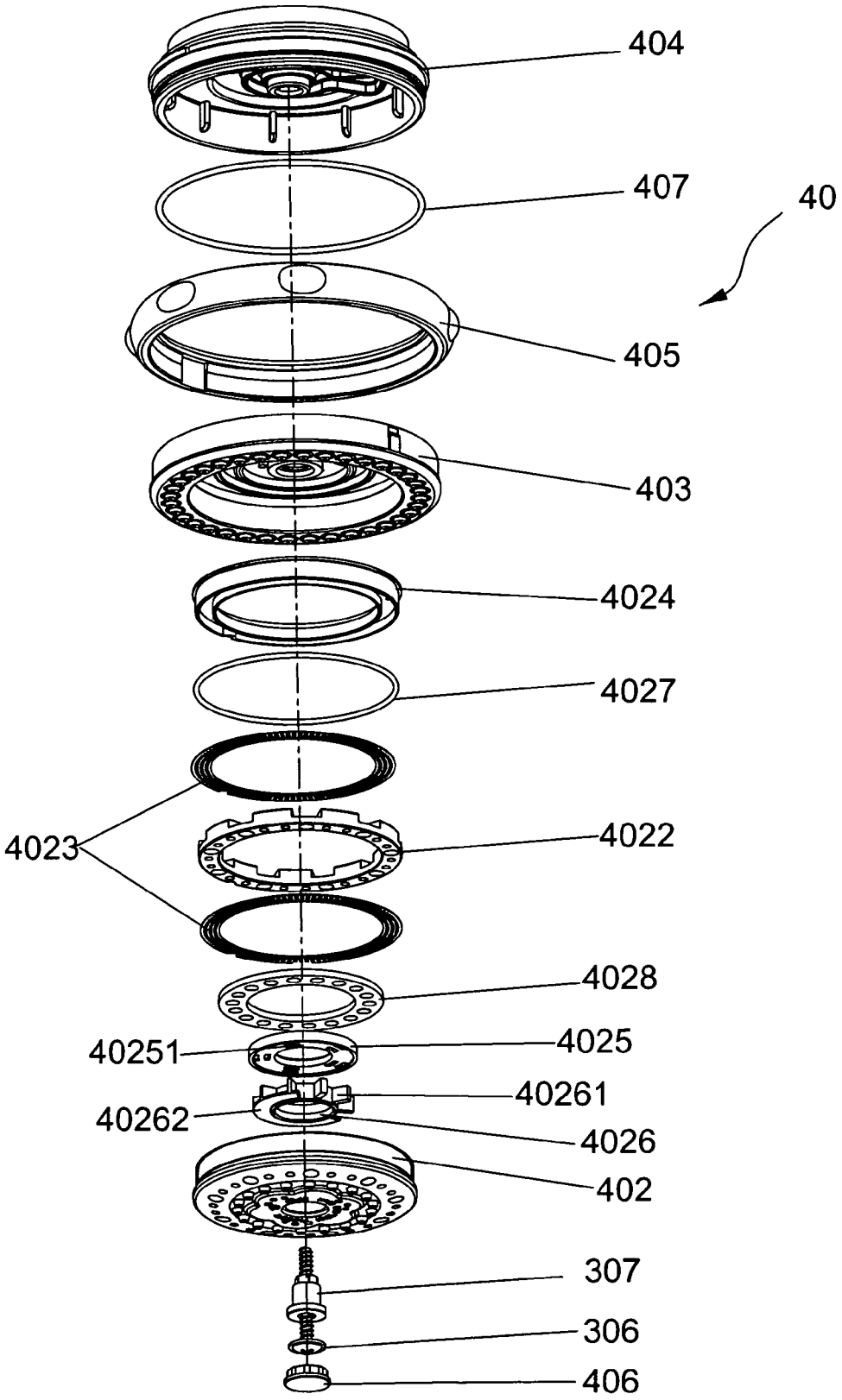
FIG. 4 is an exploded view of the outlet assembly of the showerhead of FIG. 1.

FIG. 4 provides a schematic view of the disk assembly 30, namely the lower disk 302 (with solid lines) and the upper disk 301 (with broken lines) in a first position P1 which results in a first discharge water pattern via the outlet assembly 40. In the first position P1, the first outlet 3023 and the second outlet 3024 of the lower disk 302 are aligned with the groove 3013 of the upper disk 301 to form a dual passageway through both disks 301, 302. This alignment of the first and second outlets 3023, 3024 and the groove 3013 provide a first discharge water pattern, such as steady-state discharge, via the inner faceplate 402 and/or the outer faceplate 403. Alternatively, the first and second outlets 3023, 3024 are spaced a greater distance apart than that shown in FIG. 4, whereby only the first outlet 3023 is aligned with the groove 3013 to provide the first discharge water pattern.

Figure 5:
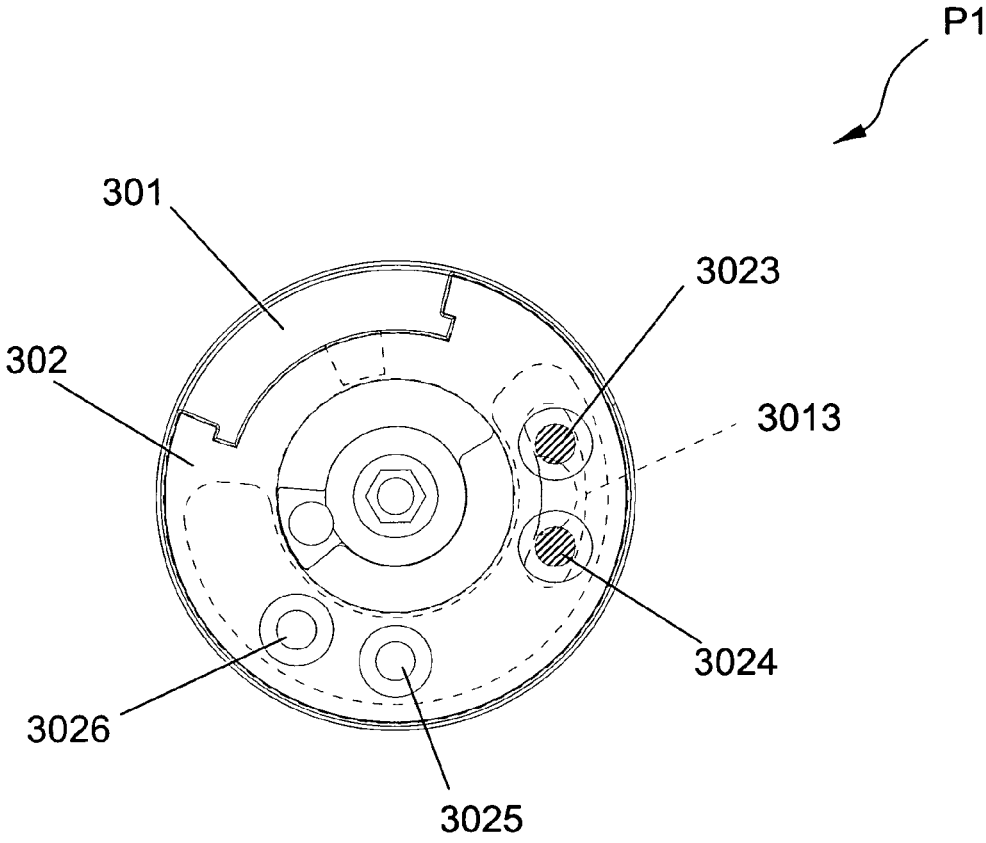
FIG. 5 is a schematic view of the disk assembly in a first position, showing a first outlet and a second outlet of a lower disk aligned with a groove of the upper disk.

FIG. 5 is a schematic view of the disk assembly 30, namely the lower disk 302 and the upper disk 301 in a second position P2 which results in a second discharge water pattern via the outlet assembly 40. In the second position P2, only the second outlet 3024 of the lower disk 302 is aligned with the groove 3013 of the upper disk 301 to form a passageway through both disks 301, 302. This alignment of the second outlet 3024 and the groove 3013 provide a second discharge water pattern, such as a "hard" pulsation pattern, via the inner faceplate 402 and/or the outer faceplate 403. In the second position P2, both the groove 3013 and water inlet hole 3012 of the upper disk 301 are positioned between the first and third outlets 3023, 3025 of the lower disk 302. Preferably, the second discharge water pattern is distinct from a first discharge water pattern. To directly arrive at the second position P2 from the first position P1, the adjusting ring 405 and the lower disk 302 are rotated counterclockwise.

Figure 6:
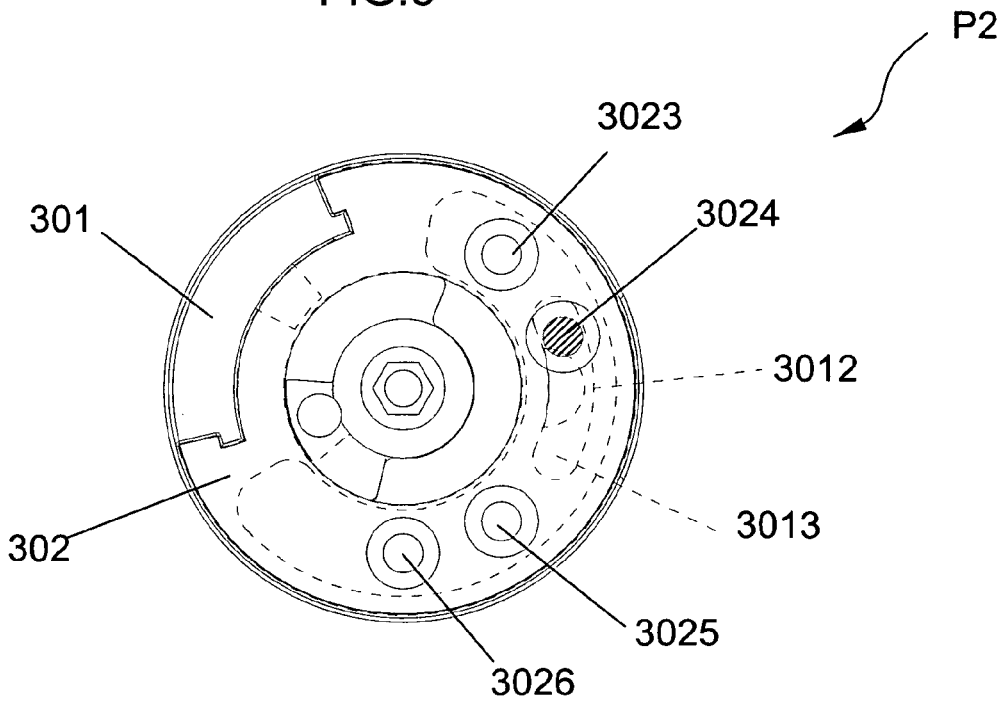
FIG. 6 is a schematic view of the disk assembly in a second position, showing the second outlet of the lower disk aligned with the groove of the upper disk.

FIG. 6 provides a schematic view of the disk assembly 30 in a third position P3 which results in a third discharge water pattern via the outlet assembly 40. In the third position P3, only the third outlet 3025 of the lower disk 302 is aligned with the groove 3013 of the upper disk 301 to form a passageway through both disks 301, 302. Consequently, the alignment of the third outlet 3025 and the groove 3013 provides a third discharge water pattern, such as a "medium" pulsation pattern, via the inner faceplate 402 and/or the outer faceplate 403. In the third position P3, both the groove 3013 and water inlet hole 3012 of the upper disk 301 are positioned between the second and fourth outlets 3024, 3026 of the lower disk 302. Preferably, the third discharge water pattern is distinct from both the first and second discharge water patterns. To directly arrive at the third position P3 from the second position P2, the adjusting ring 405 and the lower disk 302 are rotated counterclockwise.

Figure 7:
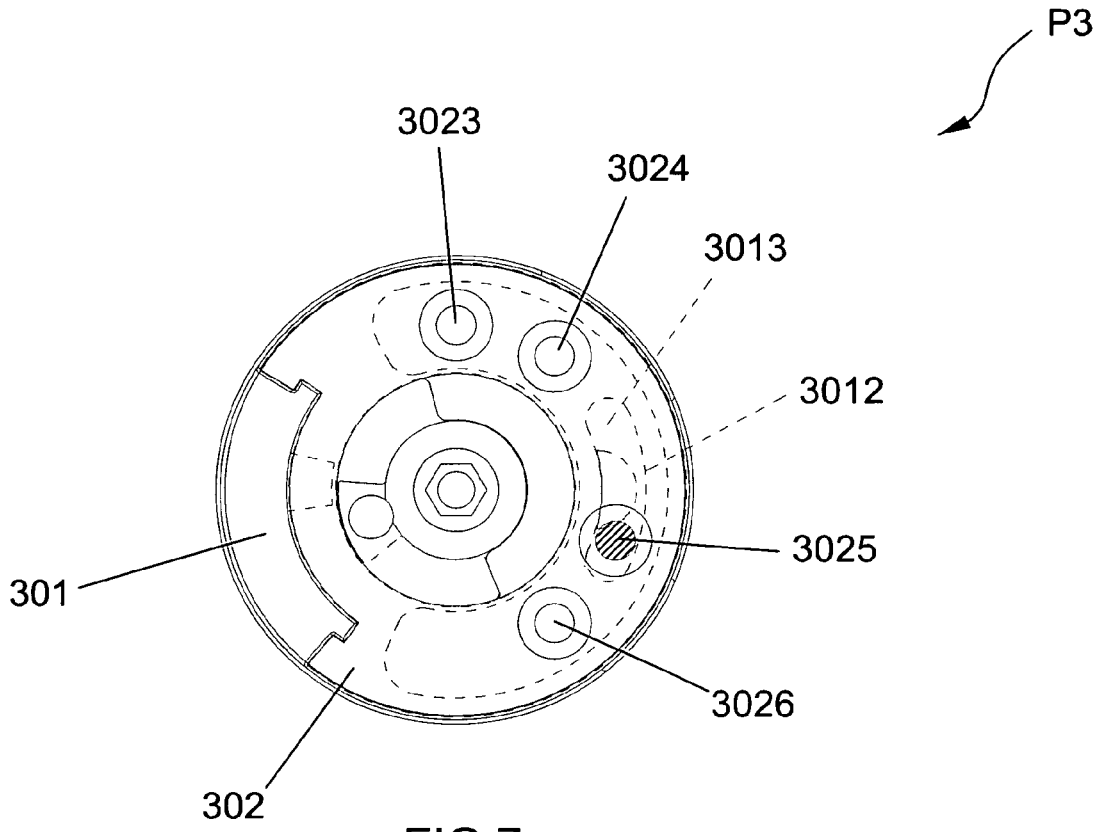
FIG. 7 is a schematic view of the disk assembly in a third position, showing a third outlet of the lower disk aligned with the groove of the upper disk.

FIG. 7 is a schematic view of the disk assembly 30 in a fourth position P4 which results in a fourth discharge water pattern via the outlet assembly 40. In the fourth position P4, the third outlet 3025 and the fourth outlet 3026 of the lower disk 302 are aligned with the groove 3013 of the upper disk 301 to form a passageway through both disks 301, 302. Thus, the alignment of the third and fourth outlets 3025, 3026 and the groove 3013 provides a fourth discharge water pattern, such as a "soft" pulsation pattern, via the inner faceplate 402 and/or the outer faceplate 403. Preferably, the fourth discharge water pattern is distinct from the first, second and third discharge water patterns.

Figure 8:
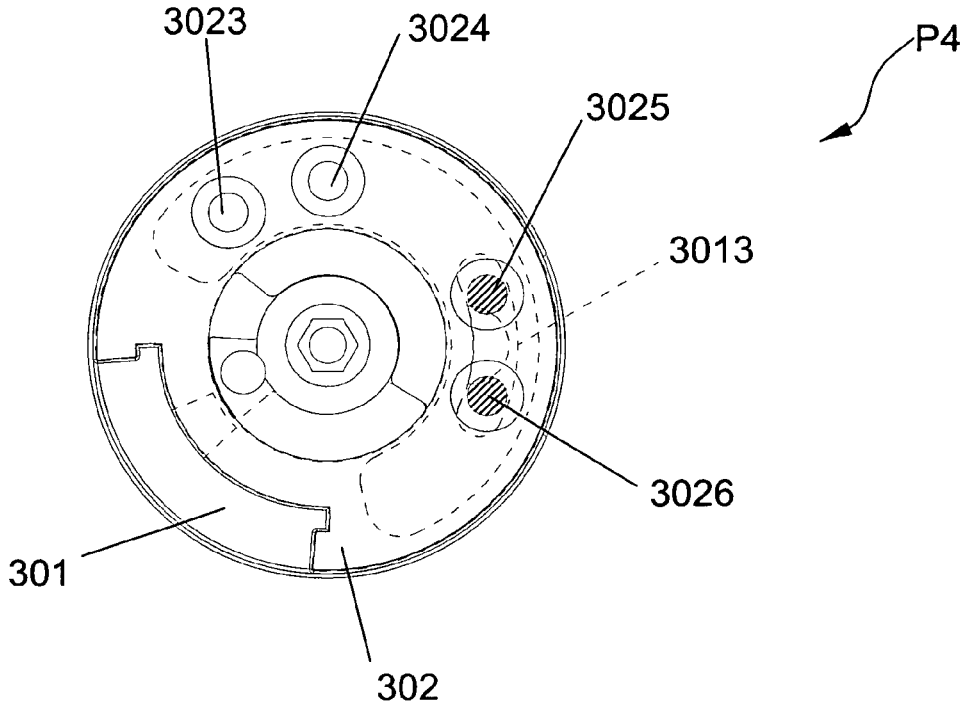
FIG. 8 is a schematic view of the disk assembly in a fourth position, showing the third outlet and a fourth outlet of the lower disk aligned with the groove of the upper disk; and, FIG. 9 is a schematic view of the disk assembly in a fifth position, showing the fourth outlet of the lower disk aligned with the groove of the upper disk.
Figure 9:
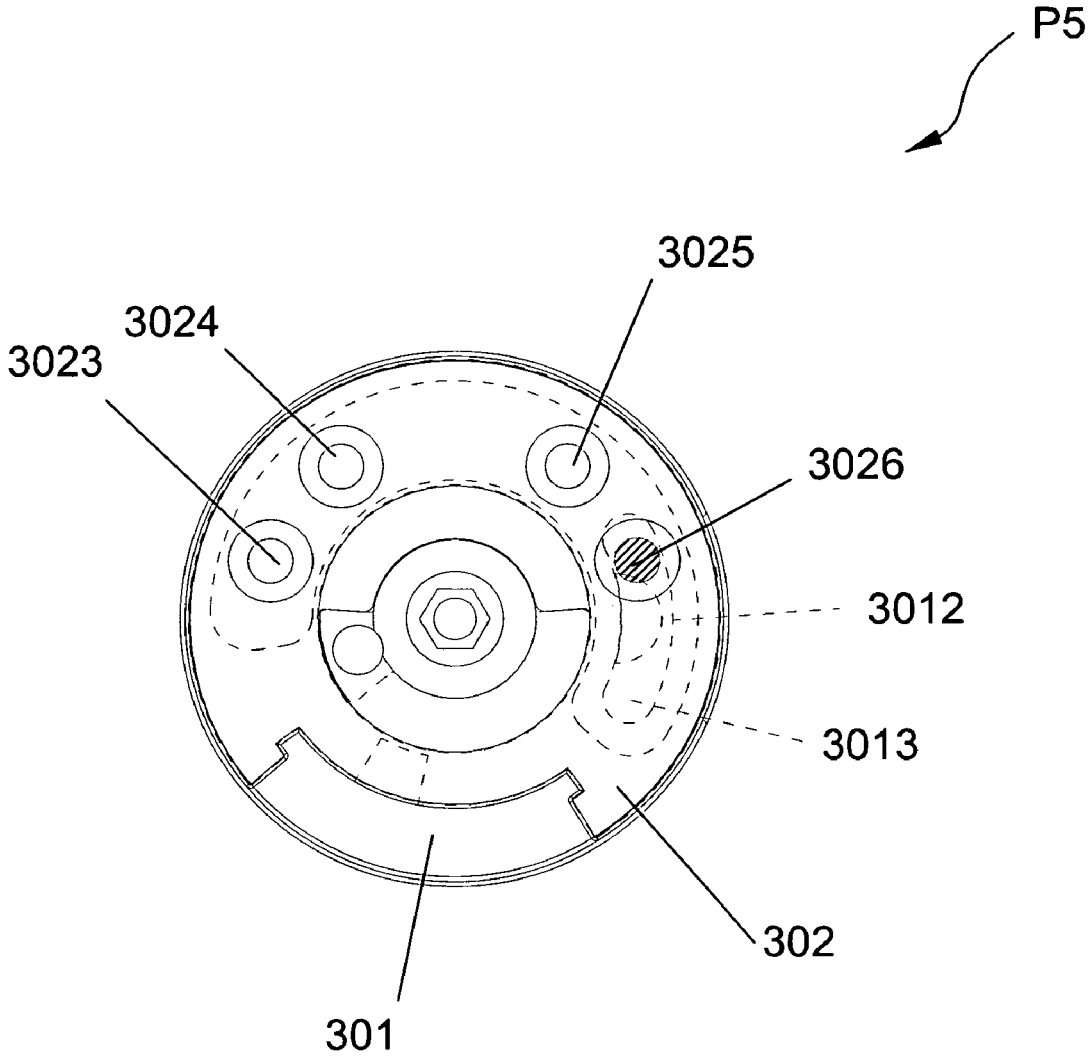

FIG. 8 is a schematic view of the disk assembly 30 in a fifth position P5 which results in a fifth discharge water pattern via the outlet assembly 40. In the fifth position P5, only the fourth outlet 3026 of the lower disk 302 is aligned with the groove 3013 of the upper disk 301 to form a passageway through both disks 301, 302. Therefore, the alignment of the fourth outlet 3026 and the groove 3013 provides a fifth discharge water pattern, such as an aerated or "bubble" water pattern, via the inner faceplate 402 and/or the outer faceplate 403. Preferably, the fifth discharge water pattern is distinct from the first through fourth discharge water patterns.

Although the foregoing paragraphs explained the operation in terms of sequential movement from the first position P1 through the fifth position P5, the showerhead 10 can be moved randomly between the various positions until the operator arrives at the desired discharge water pattern.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A showerhead capable of providing a variety of discharge water patterns, the showerhead comprising:

a wand having a water inlet and a body portion defining a receiver, the receiver having a discharge outlet and a depending lug;

an upper ceramic disk fixedly positioned within the receiver of the wand, the upper disk having a central opening through which the lug extends, the upper disk having a curvilinear groove that receives water delivered from the discharge outlet of the wand;

a lower ceramic disk movably positioned within the receiver and adjacent the upper disk, the lower disk having a first outlet, a second outlet, a third outlet and a fourth outlet all positioned radially outward of a central opening of the lower disk;

a bushing residing within the central opening of the lower disk, the bushing having a recess that receives a lower extent of the lug, whereby the lower disk is movable with respect to the upper disk;

an outlet assembly through which water is discharged, the outlet assembly operably connected to the lower disk, the outlet assembly having:

a central bore that receives an elongated fastener that extends through a depending projection of the bushing and into the lug to operably connect the outlet assembly to the wand;

an inner faceplate with a plurality of discharge outlets, the inner faceplate residing radially outward of the central bore;

an outer faceplate with a plurality of discharge outlets, the outer faceplate residing radially outward of the inner faceplate;

a flange connected to the outer faceplate and extending into the receiver of the wand; and an adjusting ring that an operator actuates to select a discharge water pattern, the adjusting ring residing radially outward of both the flange and the outer faceplate.

2. The showerhead of claim 1, the adjusting ring being moveable to a first position wherein the first outlet of the lower disk is aligned with the groove of the upper disk to provide a first discharge water pattern.

3. The showerhead of claim 1, the adjusting ring being moveable to a second position wherein the second outlet of the lower disk is aligned with the groove of the upper disk to provide a second discharge water pattern that is distinct from a first discharge water pattern.

4. The showerhead of claim 1, the adjusting ring being moveable to a third position wherein the third outlet of the lower disk is aligned with the groove of the upper disk to provide a third discharge water pattern that is distinct from both a first and a second discharge water patterns.

5. The showerhead of claim 1, the adjusting ring being moveable to a fourth position wherein the fourth outlet of the lower disk is aligned with the groove of the upper disk to provide a fourth discharge water pattern that is distinct from each of a first, second and third discharge water patterns.

6. The showerhead of claim 1, the adjusting ring being moveable to a fifth position wherein the fourth outlet of the lower disk is aligned with the groove of the upper disk to provide a fifth discharge water pattern that is distinct from each of a first, second, third and fourth discharge water patterns.

7. The showerhead of claim 2, wherein in the first position both the first and second outlet of the lower disk are aligned with the groove of the upper disk to provide the first discharge water pattern, and wherein in the fourth position both the third and fourth outlets of the lower disk are aligned with the groove of the upper disk to provide the fourth discharge water pattern.

8. An adjustable showerhead that provides a variety of discharge water patterns, the showerhead comprising:

a wand having a receiver with a discharge outlet and a depending lug;

an upper ceramic disk having a central opening that receives an extent of the lug to fixedly position the upper disk within the receiver, the upper disk having a curvilinear groove and a water inlet hole that receive water from the discharge outlet of the wand;

a lower ceramic disk movably positioned within the receiver against the upper disk, the lower disk having a first outlet, a second outlet, a third outlet and a fourth outlet arrayed along the periphery of the lower disk, the lower disk further having a bushing residing within a central opening of the lower disk, wherein the bushing receives an extent of the lug whereby the lower disk is movable with respect to the upper disk;

an outlet assembly operably connected to the lower disk, the outlet assembly having an inner faceplate with a plurality of discharge outlets, an outer faceplate residing radially outward of the inner faceplate and having a plurality of discharge outlets, and, an adjusting ring operably connected to the lower disk and residing radially outward of the outer faceplate; and, wherein the adjusting ring is moveable between a first position wherein the first outlet of the lower disk is aligned with the groove of the upper disk to provide a first discharge water pattern, and a second position wherein the second outlet of the lower disk is aligned with the groove of the upper disk to provide a second discharge water pattern, and wherein the first discharge water pattern is different than the second discharge water pattern.

9. The showerhead of claim 8, wherein in the first position both the first and second outlets of the lower disk are aligned with groove of the upper disk to provide the first discharge water pattern.

10. The showerhead of claim 8, wherein in the second position both the groove and water inlet hole of the upper disk are positioned between the first and third outlets of the lower disk.

11. The showerhead of claim 8, the adjusting ring being moveable between the first and second positions and a third position wherein the third outlet of the lower disk is aligned with the groove of the upper disk to provide a third discharge water pattern, and wherein the third discharge water pattern is different than both the first and second discharge water patterns.

12. The showerhead of claim 11, wherein in the third position both the groove and water inlet hole of the upper disk are positioned between the second and fourth outlets of the lower disk.

13. The showerhead of claim 11, the adjusting ring being moveable between the first, second and third positions and a fourth position wherein the fourth outlet of the lower disk is aligned with the groove of the upper disk to provide a fourth discharge water pattern, and wherein the fourth discharge water pattern is different than the first, second and third discharge water patterns.

14. The showerhead of claim 13, wherein in the fourth position both the third and fourth outlets of the lower disk are aligned with the groove of the upper disk to provide the fourth discharge water pattern.

15. The showerhead of claim 13, the adjusting ring being moveable between the first, second, third and fourth positions and a fifth position wherein only the fourth outlet of the lower disk is aligned with the groove of the upper disk to provide a fifth discharge water pattern, and wherein the fifth discharge water pattern is different than the first, second, third and fourth discharge water patterns.

16. The showerhead of claim 8, wherein the outlet assembly has a central bore that receives an elongated fastener that extends through a depending projection of the bushing and into the lug to operably connect the outlet assembly to the wand.

17. The showerhead of claim 16, wherein the bushing has an upper recess that receives a lower extent of the lug whereby the lower disk is movable with respect to the upper disk.

18. The showerhead of claim 16, wherein the outlet assembly includes a flange extending from the outer faceplate and into the receiver of the wand, and wherein the adjusting ring is operably connected to the flange and the outer faceplate.

19. An adjustable showerhead that provides a variety of discharge water patterns, the showerhead comprising:

a wand having a receiver with a discharge outlet and a depending lug;

a ceramic disk assembly residing within the receiver of the wand, the disk assembly comprising:

an upper ceramic disk secured to the receiver by engagement with the depending lug, the upper disk having a curvilinear groove in an upper surface of the upper disk and a water inlet hole extending through the upper disk and coincident with the groove; and, a lower ceramic disk movably positioned against the upper disk, the lower disk having a first outlet and a second outlet arrayed along the periphery of the lower disk, the lower disk further having a bushing residing within a central opening of the lower disk, wherein the bushing receives an extent of the lug to operably connect the lower disk to the upper disk and the receiver;

an outlet assembly operably connected to the lower disk, the outlet assembly having an inner faceplate with a plurality of discharge outlets, an outer faceplate residing radially outward of the inner faceplate and having a plurality of discharge outlets, and, an adjusting ring operably connected to the lower disk and residing radially outward of the outer faceplate; and, wherein the adjusting ring is moveable between a first position wherein the first outlet of the lower disk is aligned with the groove of the upper disk to provide a first discharge water pattern, and a second position wherein the second outlet of the lower disk is aligned with the groove of the upper disk to provide a second discharge water pattern that is distinct from the first discharge water pattern.

20. The showerhead of claim 19, the adjusting ring being moveable to a third position wherein a third outlet of the lower disk is aligned with the groove of the upper disk to provide a third discharge water pattern that is distinct from both the first and second discharge water patterns.

21. The showerhead of claim 20, the adjusting ring being moveable to a fourth position wherein a fourth outlet of the lower disk is aligned with the groove of the upper disk 301 to provide a fourth discharge water pattern that is distinct from each of the first, second and third discharge water patterns.

22. The showerhead of claim 21, wherein in the fourth position both the third and fourth outlets of the lower disk are aligned with the groove of the upper disk to provide the fourth discharge water pattern.

23. The showerhead of claim 21, the adjusting ring being moveable to a fifth position wherein only the fourth outlet of the lower disk is aligned with the groove of the upper disk to provide a fifth discharge water pattern that is distinct from each of the first, second, third and fourth discharge water patterns.

24. The showerhead of claim 23, wherein the first, second, third and fourth outlets of the lower disk are radially outward of the central opening of the lower disk.

25. The showerhead of claim 19, wherein in the first position both the first and second outlets of the lower disk are aligned with the groove of the upper disk to provide the first discharge water pattern.

* * * * *